US006203368B1

(12) United States Patent
Weidner

(10) Patent No.: US 6,203,368 B1
(45) Date of Patent: Mar. 20, 2001

(54) ELECTRICAL CONNECTOR WITH SEIZURE SCREW

(75) Inventor: Kevin Edward Weidner, Hummelstown, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/190,846

(22) Filed: Nov. 12, 1998

Related U.S. Application Data

(60) Provisional application No. 60/068,338, filed on Dec. 19, 1997.

(51) Int. Cl.[7] ..... H01R 9/05; H01R 33/20

(52) U.S. Cl. ..... 439/579; 439/675

(58) Field of Search ..... 439/675, 579, 439/578, 580, 583, 824, 585, 277, 825; 333/101, 105

(56) References Cited

U.S. PATENT DOCUMENTS

| | | | | |
|---|---|---|---|---|
| 3,983,457 | | 9/1976 | Smith | 361/679 |
| 3,989,333 | | 11/1976 | Cauldwell | 439/76.1 |
| 4,094,574 | | 6/1978 | Gunn | 439/578 |
| 4,165,911 | | 8/1979 | Laudig | 439/314 |
| 4,206,963 | * | 6/1980 | English et al. | 439/581 |
| 4,226,495 | | 10/1980 | Palle et al. | 439/535 |
| 4,990,109 | | 2/1991 | Romerein et al. | 439/801 |
| 5,209,678 | * | 5/1993 | Allen et al. | 439/672 |
| 5,677,578 | | 10/1997 | Tang | 307/147 |
| 5,814,905 | | 9/1998 | Tang | 307/147 |

FOREIGN PATENT DOCUMENTS

| | | | |
|---|---|---|---|
| 2941071 A1 | 4/1981 | (DE) | H01R/9/05 |
| 0 187 203 | 7/1986 | (EP) | H02G/15/08 |
| WO 97/04501 | 2/1997 | (WO) | H01R/15/08 |

* cited by examiner

*Primary Examiner*—Brian Sircus
*Assistant Examiner*—Chandrika Prasad

(57) ABSTRACT

An electrical connector (10) seatable in a hole (16) in a enclosure wall (14) and having an outer conductive shell (30) containing a dielectric sleeve (32) holding a seizure contact (34) at an inner end to compressively engage an inner conductor (18) of a coaxial cable entering the enclosure (12). During servicing of the enclosure (12), the (10) is matable at an opposed end with a connector (100) of a jumper cable to connect the jumper cable the to providing uninterrupted CATV service to customers.

8 Claims, 5 Drawing Sheets

ELECTRICAL CONNECTOR WITH SEIZURE SCREW

This Application claims benefit to Provisional Application 60/068338 filed Dec. 19, 1997.

FIELD OF THE INVENTION

The present invention is related to the field of electrical connectors and more particularly to connectors having seizure screws.

BACKGROUND OF THE INVENTION

Enclosures are utilized in cable television signal transmission to provide for the eventual interconnection of the coaxial distribution cable to a plurality of subscriber cables, the enclosures being known as signal conditioning/distribution component boxes and being formed of rugged, durable metal suitable for an outside environment that seals the cable exits against moisture entry. It is desired for such enclosures to provide for the use of jumper cables to establish a temporary connection of the incoming main signal distribution cable to the outgoing main signal distribution cable during servicing of the enclosure, thus providing continued service to the existing subscribers.

It is desired to adapt the enclosure to facilitate connection of the jumper cable to the incoming and outgoing main distribution cable, and disconnection therefrom.

It is also desired that the signal conditioning/distribution component box and its electronic components not be damaged by arcing that may occur during connection or disconnection of a jumper cable. Also, when the jumper cable is not in service, it is desired that signal performance of the signal conditioning/distribution component box not be adversely affected by the presence of the adapter.

SUMMARY OF THE INVENTION

In the present invention, an adapter is defined that is affixable to the enclosure in a manner that permits connection with and disconnection from a jumper cable at a separable interface, while establishing an electrical connection with the main distribution cable signal conductor by a seizure contact. A separable mechanical interface and seizure contact are integrated into a one piece conductive connector shell. The connector shell includes a threaded portion adjacent the seizure contact at one end thereof, to be threaded into an aperture of the conductive enclosure wall adjacent a subscriber cable exit. The seizure contact is affixed within a large diameter bore end of a dielectric sleeve affixed into the end of the connector shell forwardly of the threaded portion and defines a compression face at an end of the adapter to abut the inner conductor of the main distribution cable at the cable exit of the enclosure. A contact having a plurality of resilient beams defines an annular band of pin-engaging springs for assured current-carrying capability, is disposed within a central cavity of the seizure contact open away from the compression face and toward the separable mating interface aligned with a small diameter bore of the dielectric sleeve; the annular contact band is matable with an elongate pin of a mating connector upon mating at the separable interface at an end opposed to the seizure contact. The adapter and the matable connector may utilize a bayonet-style coupling (BNC) to facilitate mating and unmating.

An embodiment of the invention will now be described by way of example with reference to the accompanying drawings.

DETAILED DESCRIPTION

Figure 1:
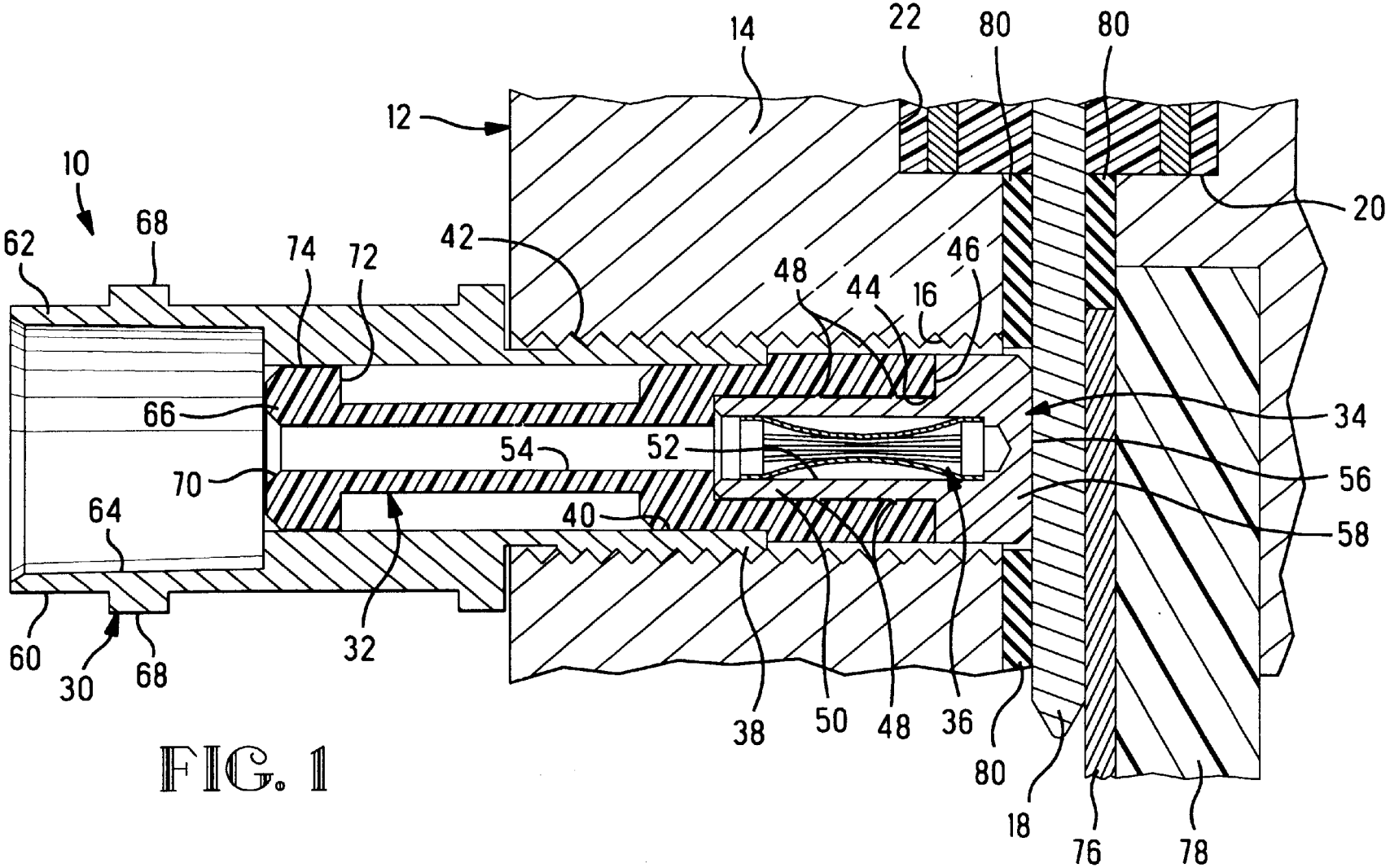
FIG. 1 is a longitudinal cross-sectional view of the adapter assembly of the present invention disposed in a enclosure wall abutting a coaxial cable inner conductor.

Adapter 10 is shown in FIG. 1 affixed in a wall 14 of a conductive enclosure 12, threaded into a hole 16 thereof and abutting an inner conductor 18 of a coaxial cable 20 entering a cable exit 22 of the enclosure, the adapter being orthogonal to inner conductor 18. It is seen that inner conductor 18 of main signal distribution cable 20 is in electrical connection with a terminal 76 extending to the interior of enclosure 12 for electrical connection to the signal conditioning/distribution circuitry during normal service. A preferably low resilience dielectric platform 78 isolates the terminal 76 from the enclosure wall while providing for assured electrical engagement of the inner conductor against the terminal when pressed thereagainst by the seizure screw of adapter 10. A dielectric sleeve 80 surrounds inner conductor 18 to electrically isolate it from the enclosure wall, with dielectric sleeve 80 preferably being of elastomeric material to provide sealing at the cable exit.

Figure 2:
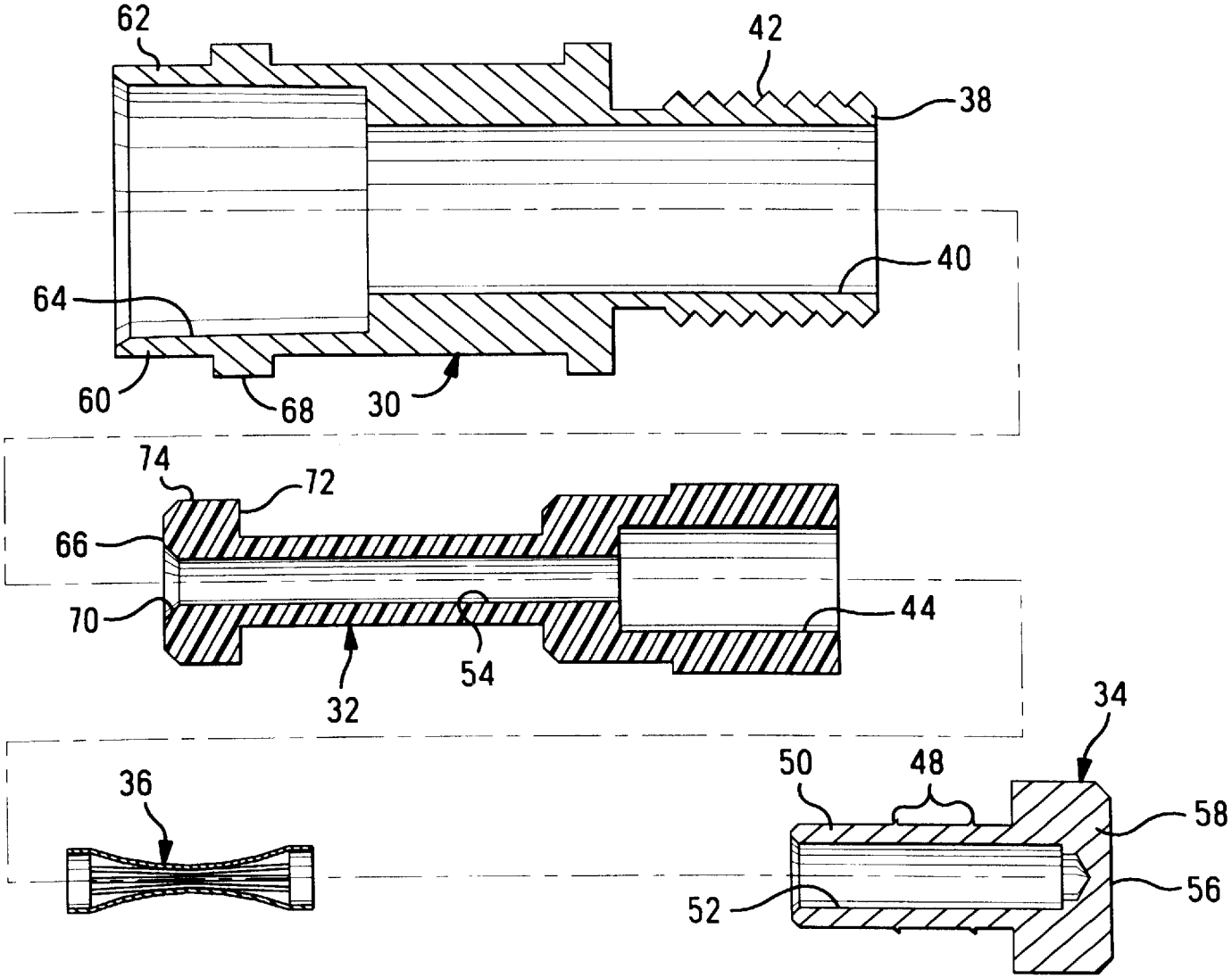
FIG. 2 is an exploded longitudinal cross-sectional view of the adapter assembly of FIG. 1.

Adapter 10 of FIGS. 1 and 2 includes a conductive shell 30, a dielectric sleeve 32, a seizure contact 34 and a annular contact band 36. Dielectric sleeve 32 is disposed at a first end 38 of shell 30 in a large diameter bore 40 thereof forwardly of a threaded outer surface region 42 of shell 30. Seizure contact 34 is affixed in a large diameter passageway portion 44 of dielectric sleeve 32 at leading end 46 thereof, by interference fit such as by retention barbs 48 along flange 50 thereof that bite into inner surfaces of passageway portion 44. Annular contact band 36 is disposed in a central cavity 52 of seizure contact 34 such as by friction fit, the blind bore opening onto smaller diameter passageway portion 54 of dielectric sleeve 32. Seizure contact 34 defines an imperforate abutment surface 56 along leading end 58 thereof to abut the coaxial cable inner conductor 18 under compression upon adapter being threaded into hole 16 of enclosure 12.

Separable mating interface 60 of adapter 10 is defined by a shroud 62 of conductive outer shell 30 defining a large cavity 64 extending to second end 66 of dielectric sleeve 32 and in communication with and aligned with smaller diameter passageway portion 54 thereof. Shroud 62 includes a plurality of outwardly extending bosses 68 to provide for a bayonet style coupling with the mating connector 100 (FIGS. 3 to 5) at the separable mating interface 60, as seen in FIG. 5, and using a coupling ring 108 of connector 100. Alternatively, the coupling ring may be placed on the adapter and a shroud with pins placed on the mating connector.

Smaller diameter passageway portion 54 includes a chamfered pin-receiving entrance 70 to facilitate receipt thereinto of the leading end of the elongate pin contact of mating connector 100. Annular groove 72 along outer surface 74 of dielectric sleeve 32 enhances dielectric properties of the connector for coaxial transmission.

Figure 3B:
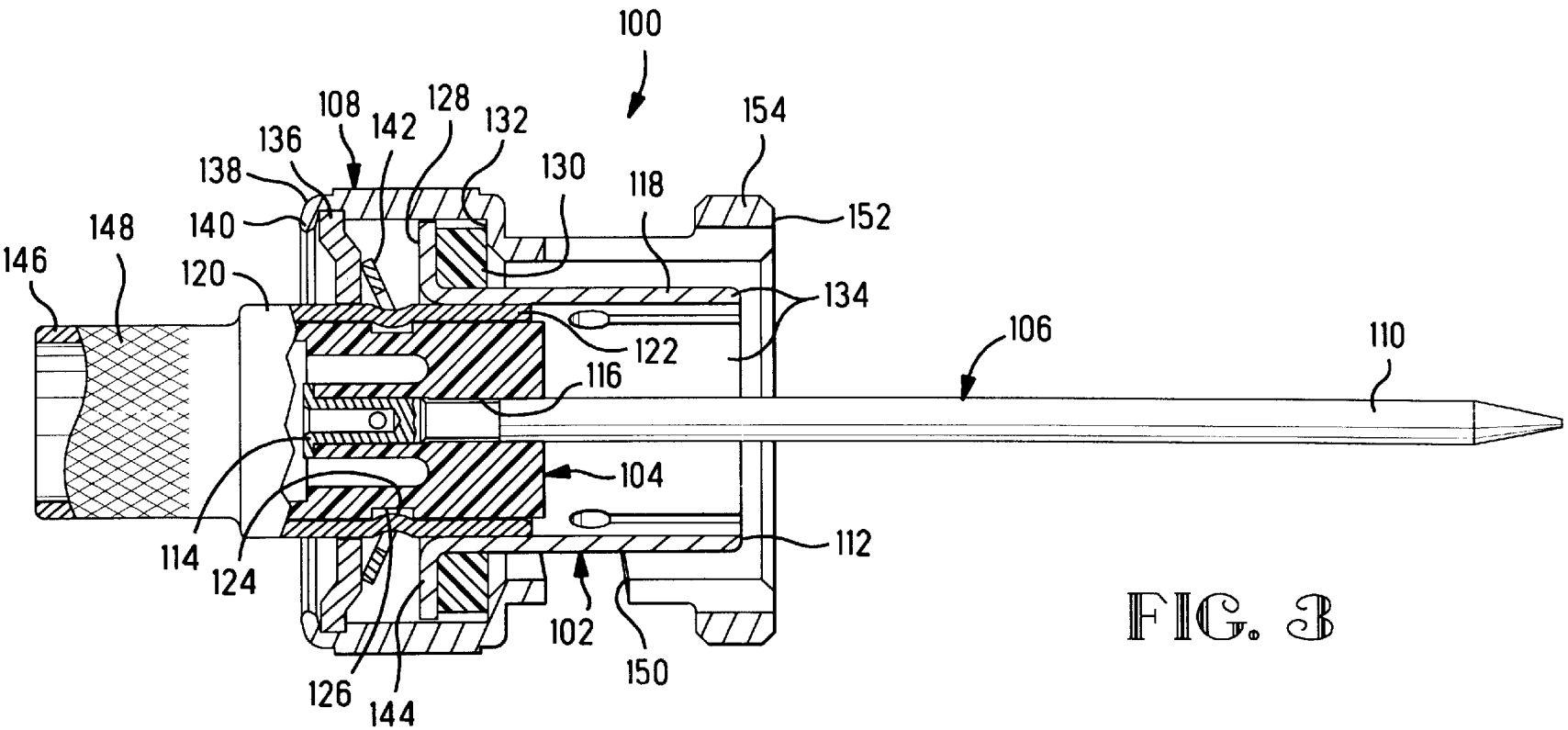
FIGS. 3 and 4 are longitudinal cross-sectional assembly and exploded views of a connector matable with the adapter assembly of FIGS. 1 and 2.
Figure 4:
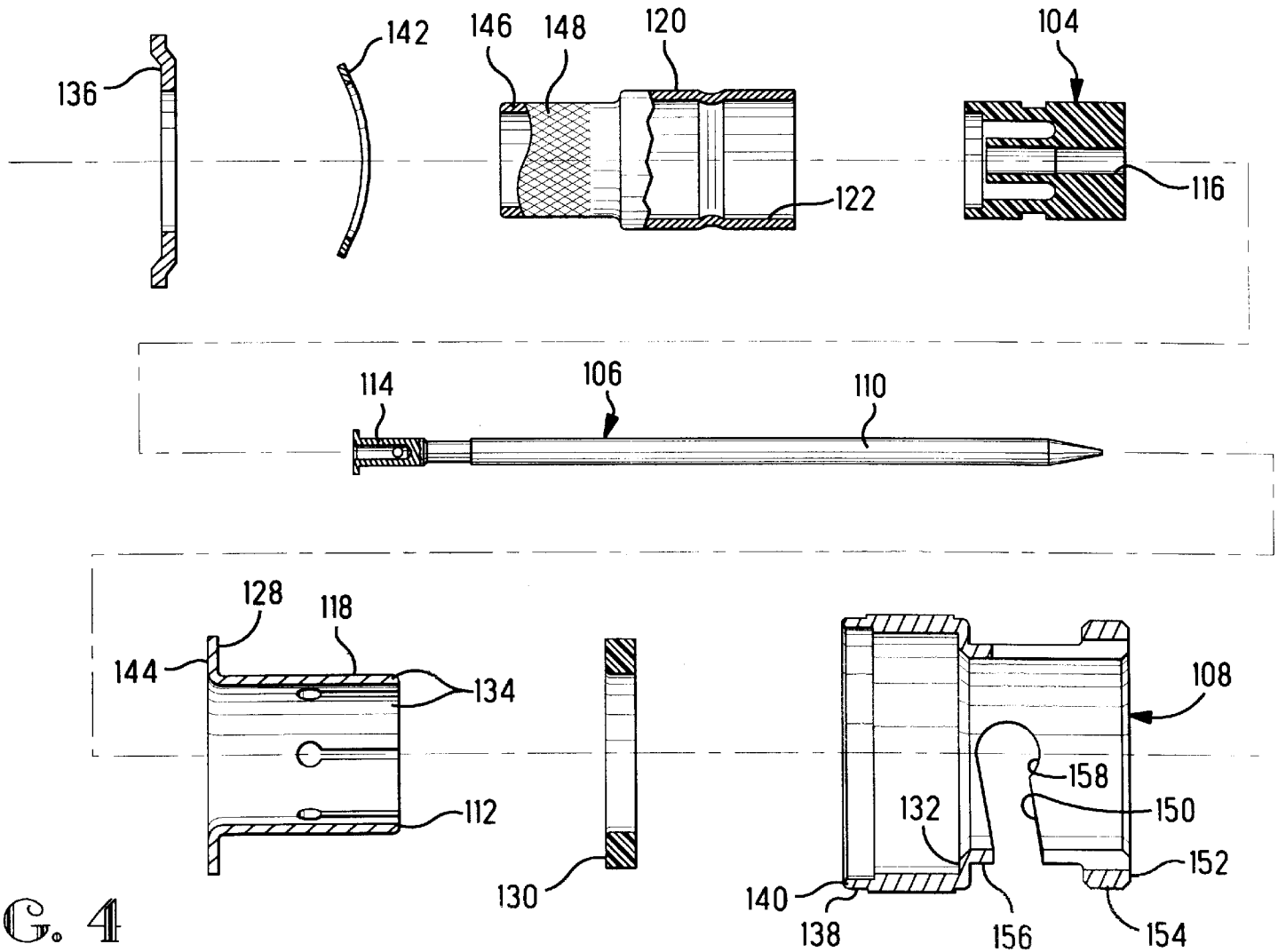
Figure 5:
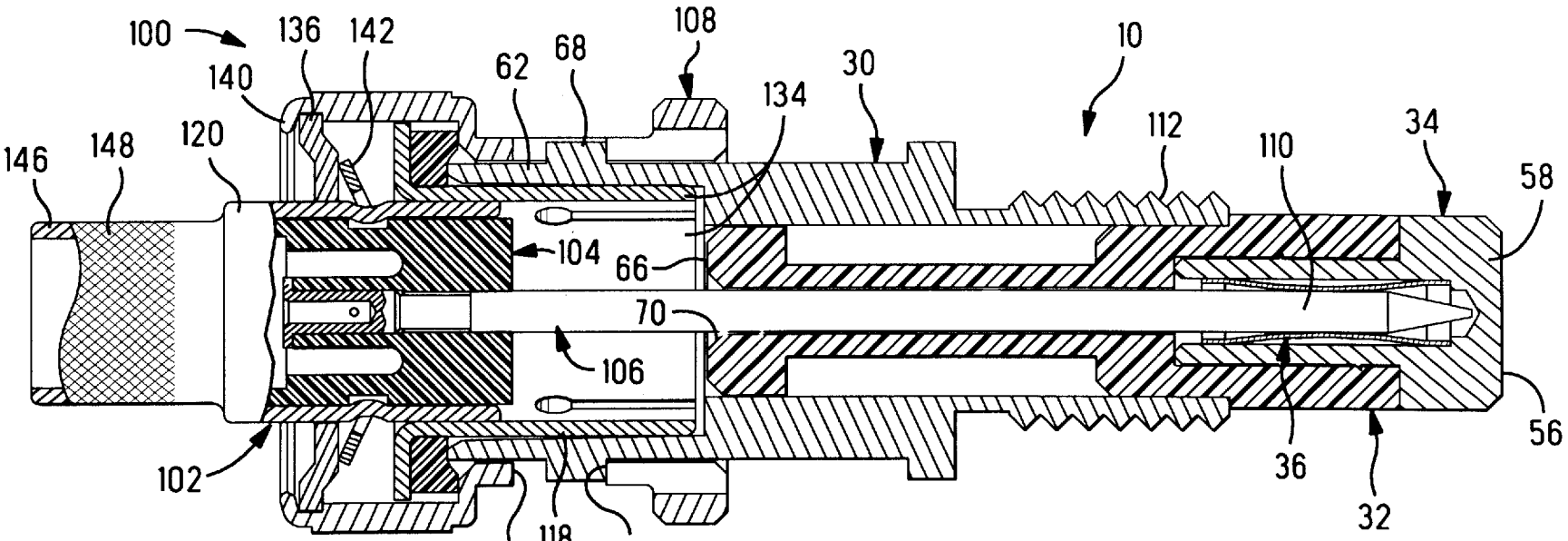
FIG. 5 is a longitudinal cross-sectional view of the connectors of FIGS. 1 to 4 in mated condition.

Mating connector 100 is of the coaxial type generally termed a BNC plug, and is seen in FIGS. 3 and 4 to include an outer conductor assembly 102, dielectric sleeve 104, inner contact 106 and a coupling ring 108. Inner contact 106 includes an elongate pin contact section 110 protruding beyond the leading end 112 of the outer conductor assembly 102 and the coupling ring 108, and also includes a socket contact section 114 seated within bore 116 of dielectric sleeve 104 into which is received an inner conductor of a coaxial jumper cable (not shown), which is crimped or preferably soldered thereto.

Outer conductor assembly 102 is seen to include a forward member 118 and a rearward member 120, with dielectric sleeve 104 seated in a forward end 122 of rearward member 120 such as by embossments 124 disposed in an annular groove 126 surrounding the dielectric sleeve. Forward member 118 is movable with respect to rearward member 120 along the outer surfaces of forward end 122, and is trapped in coupling ring 108 by outturned flange 128 adjacent to a gasket 130 and both disposed behind a ledge 132 of the coupling ring. Forward member 118 includes a forward end defining a plurality of beams 134 adapted to be compressed upon insertion into shroud 62 of conductive shell 30 of adapter 10 (see FIG. 5).

Mating connector 100 is seen to include a transverse rear plate 136 trapped in trailing end 138 of coupling ring 108 rearwardly of forward outer conductor member 118 by inturned end 140 of the coupling ring. Rear plate 136 forwardly biases a Belleville washer 142 to abut a rearwardly facing surface 144 of forward outer conductor member 118 along an outturned flange 128 thereof. Rearward end 146 of rearward outer conductor member 120 defines a flange preferably with a knurled outer surface 148 for establishing a grounding connection with the shield braid of the jumper cable (not shown).

Coupling ring 108 is seen in FIG. 4 to define a pin-receiving slot 150 corresponding to each pin 68 of the shroud of adapter 10 and extending from an entrance adjacent leading end 152 of the coupling ring at a larger diameter leading end portion 154 thereof, the pin-receiving slot extending helically around a smaller diameter portion 156 of the coupling ring for a selected angular distance such as a quarter of the circumference. Pin-receiving slot 150 concludes in a pin seat 158 so that a pin may become seated in the pin seat (FIG. 5) upon full mating of the connectors after having first entered the slot entrance near the leading end 152 of the coupling ring.

During in-service use of the adapter as a temporary connection, mating connector 100 is terminated onto an end of a jumper coaxial cable and is matable with and unmatable from adapter 10 at separable interface 60, with adapter 10 being fixed in threaded hole 16 of enclosure 12 and remaining continuously in electrical contact with inner conductor 18 of the subscriber cable 20. During in-service use when the jumper cable is not connected thereto, the adapter will not abnormally act as an antenna even though its contact remains engaged with inner conductor 18; use of the annular contact band within a drilled bore of the seizure contact does not result in an undesirable antenna effect, unlike socket contacts that extend outwardly into the separable mating interface.

Adapter 10 is adapted to be retrofitted into existing in-service enclosures, having the same outer envelope at the forward end as existing adapters. The annular contact band 36 may be of the conventional type sold by AMP Incorporated and known as the AMP Louvertac Band contact with a proven current-carrying capability of 15 amperes and "hot" mate and unmate capability, with an array of concave springs therealong to grip the outer surface of the elongate pin contact section of mating connector 100. Although some level of arcing may occur during "hot" mating and unmating, such arcing would be safely contained entirely within the adapter remote from any electronic components of the signal conditioning/distribution component box. The contact band is friction fitted into a drilled bore of the seizure contact, providing compensation for diametrical tolerance stack-up. The elongated array of concave springs are sized to provide compensation for longitudinal tolerance stack-up between the adapter and the mating connector.

What is claimed is:

1. An electrical connector for a component box, the connector comprising:

a conductive shell having a central bore;

an insulative sleeve having a central bore of a first diameter at a proximal end thereof, the sleeve housed within the shell central bore;

a contact extending proximally from within the proximal central bore of the sleeve, the contact having an abutment surface at its proximal-most end configured for perpendicular engagement with a coaxial cable conductor and a central cavity opening at a distal end thereof, the cavity situated coaxially with the shell central bore, the sleeve proximal bore and a sleeve distal bore of a second diameter that extends from the sleeve proximal bore to a distal end of the sleeve.

2. The electrical connector as set forth in claim 1 wherein said conductive shell includes an external screw thread.

3. The electrical connector as set forth in claim 1 wherein said conductive outer shell includes a shroud at a distal-most end defining a cavity for receipt of a mating coaxial connector.

4. The electrical connector as set forth in claim 3 wherein said shroud includes a plurality of outwardly extending bosses to provide for a bayonet coupling with said mating connector.

5. The electrical connector as set forth in claim 1 w1herein said contact includes an imperforate outer end of large transverse area defining a compression face for assuring an electrical connection with a coaxial cable conductor.

6. The electrical connector as set forth in claim 1 wherein said contact includes a socket contact section at a proximal-most end of the contact cavity open to the shell central bore for electrical connection to a complimentary male contact of a mating coaxial connector.

7. The electrical connector as set forth in claim 6 further comprising an annular band of pin-engaging springs seated in said contact cavity to establish a plurality of electrical connections of assured current-carrying capability between said complementary male contact of said mating coaxial connector and said contact upon insertion of said complementary male contact into said cavity.

8. The electrical connector as set forth in claim 7 wherein said contact includes a plurality of outwardly directed barbs for self-retention of said contact in the proximal central bore of the insulative sleeve.

* * * * *